US009711270B2

(12) United States Patent
Marusawa et al.

(10) Patent No.: US 9,711,270 B2
(45) Date of Patent: Jul. 18, 2017

(54) ELECTRONIC COMPONENT

(71) Applicant: Murata Manufacturing Co., Ltd., Kyoto-fu (JP)

(72) Inventors: Hiroshi Marusawa, Nagaokakyo (JP); Takaomi Toi, Nagaokakyo (JP); Kosuke Ishida, Nagaokakyo (JP); Mizuho Katsuta, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/047,141

(22) Filed: Feb. 18, 2016

(65) Prior Publication Data

US 2016/0247623 A1 Aug. 25, 2016

(30) Foreign Application Priority Data

Feb. 25, 2015 (JP) ..... 2015-034667

(51) Int. Cl.

| | |
|---|---|
| ***H01F 27/24*** | (2006.01) |
| ***H01F 5/00*** | (2006.01) |
| ***H01F 27/255*** | (2006.01) |
| ***H01F 17/00*** | (2006.01) |
| ***H01F 17/04*** | (2006.01) |

(52) U.S. Cl.

CPC ..... *H01F 27/255* (2013.01); *H01F 17/0013* (2013.01); *H01F 17/04* (2013.01)

(58) Field of Classification Search

CPC ..... H01F 27/255; H01F 27/2804; H01F 2027/2809; H01F 17/04; H01F 17/0013; H01F 3/08; H01F 2017/0093

USPC ..... 336/200, 223, 234

See application file for complete search history.

(56) References Cited

U.S. PATENT DOCUMENTS

| | | | | |
|---|---|---|---|---|
| 2004/0183643 | A1* | 9/2004 | Brunner | G08B 13/2402 336/200 |
| 2004/0263309 | A1 | 12/2004 | Ito et al. | |
| 2006/0176138 | A1* | 8/2006 | Ito | H01F 17/0013 336/200 |
| 2011/0240331 | A1* | 10/2011 | Kikuchi | C09D 179/08 174/110 R |
| 2014/0184374 | A1 | 7/2014 | Park et al. | |
| 2015/0371752 | A1* | 12/2015 | Park | H01F 27/255 336/200 |

FOREIGN PATENT DOCUMENTS

| | | | |
|---|---|---|---|
| CN | 1260746 | C | 6/2006 |
| JP | 2013-153184 | A | 8/2013 |

* cited by examiner

*Primary Examiner* — Mangtin Lian

(74) *Attorney, Agent, or Firm* — Studebaker & Brackett PC

(57) ABSTRACT

A common mode choke coil as an electronic component includes a laminate. The laminate includes insulating layers stacked in a thickness direction and has a recess sinking in a stacking direction of the insulating layers. The laminate includes at least one coil conductor therein. The recess is filled with a magnetic resin material. The magnetic resin material is formed of a magnetic powder-containing resin that is a mixture of a soft magnetic metal powder and a thermosetting resin. The soft magnetic metal powder has an average particle size of 12 μm or less. The magnetic powder-containing resin contains 65 vol % or more and 85 vol % or less of the soft magnetic metal powder.

6 Claims, 3 Drawing Sheets

ELECTRONIC COMPONENT

CROSS REFERENCE TO RELATED APPLICATIONS

This application claims benefit of priority to Japanese Patent Application 2015-034667 filed Feb. 25, 2015, the entire content of which is incorporated herein by reference.

TECHNICAL FIELD

The present disclosure relates to electronic components, and more particularly to an electronic component, such as a common mode choke coil, that includes a coil conductor and a magnetic resin material.

BACKGROUND

Japanese Unexamined Patent Application Publication No. 2013-153184 discloses a common mode choke coil. The common mode choke coil disclosed in Japanese Unexamined Patent Application Publication No. 2013-153184 includes a ferrite substrate formed of a ferrite sintered compact, such as Ni—Zn ferrite. An insulating layer formed of a cured thermosetting polyimide resin material is formed on the ferrite substrate. In the insulating layer, coil conductor layers formed of conductive materials, such as Cu, Au, Al, or Ag, are formed so that the conductor layers are surrounded by the insulating layer. On the insulating layer containing the central part (magnetic core part) of the coil conductor layer, a composite ferrite resin layer formed of an epoxy resin material containing ferrite particles is formed.

SUMMARY

In the aforementioned common mode choke coil, for example, Ni—Zn ferrite is used for ferrite particles (oxide magnetic material) for high frequency. However, Ni—Zn ferrite powder has many open pores and thus the epoxy resin material may fail to contain 62 vol % or more of ferrite particles. In this case, the composite ferrite resin layer has a low magnetic permeability μ (μ<6), which is not suitable to ensure sufficiently high impedance values (Z values) in a high-frequency area of the common mode choke coil, for example, at 100 MHz.

Accordingly, it is a primary object of the present disclosure to provide an electronic component that can ensure high impedance values.

An electronic component according to one embodiment of the present disclosure includes a laminate including insulating layers stacked in a thickness direction and having a recess recessed in a stacking direction of the insulating layers; and at least one coil conductor provided in the laminate, wherein the recess is filled with a magnetic resin material. The magnetic resin material is formed of a magnetic powder-containing resin that is a mixture of a soft magnetic metal powder and a thermosetting resin. The soft magnetic metal powder has an average particle size of 12 μm or less, and the magnetic powder-containing resin contains 65 vol % or more and 85 vol % or less of the soft magnetic metal powder.

In the electronic component according to the embodiment of the present disclosure, the soft magnetic metal powder is preferably formed of a crystalline Fe—Ni alloy or a crystalline Fe—Si alloy, and the thermosetting resin is preferably formed from an aromatic tetracarboxylic dianhydride and an aromatic diamine.

In the electronic component according to the embodiment of the present disclosure, the soft magnetic metal powder preferably has a surface with an insulating coating.

In the electronic component according to the embodiment of the present disclosure, the magnetic resin material filling the recess of the laminate is formed of a magnetic powder-containing resin that is a mixture of a soft magnetic metal powder and a thermosetting resin. The soft magnetic metal powder has an average particle size of 12 μm or less, and the powder-containing resin contains 65 vol % or more and 85 vol % or less of the soft magnetic metal powder. The electronic component according to the embodiment of the present disclosure thus achieves increased Z values (increased μ values) in a higher frequency area to provide electronic components, such as common mode choke coils, used as common mode filters for high frequency differential transmission.

When the soft magnetic metal powder is formed of a crystalline Fe—Ni alloy or a crystalline Fe—Si alloy and the thermosetting resin is formed from an aromatic tetracarboxylic dianhydride and an aromatic diamine in the electronic component according to the embodiment of the present disclosure, increased Z values (increased μ values) are achieved in a much higher frequency area and the filling ability and printing ability of the magnetic resin material can be improved due to reduced viscosity.

When the soft magnetic metal powder has a surface with an insulating coating in the electronic component according to the embodiment of the present disclosure, increased Z values (increased μ values) and increased Q values are achieved in a much higher frequency area and electronic components, such as common mode choke coils, used as common mode filters for high frequency differential transmission are provided.

According to the embodiment of the present disclosure, an electronic component that can ensure high impedance values is obtained.

Other features, elements, characteristics, and advantages of the present disclosure will become more apparent from the following detailed description of embodiments of the present disclosure with reference to the attached drawings.

DETAILED DESCRIPTION

Figure 1:
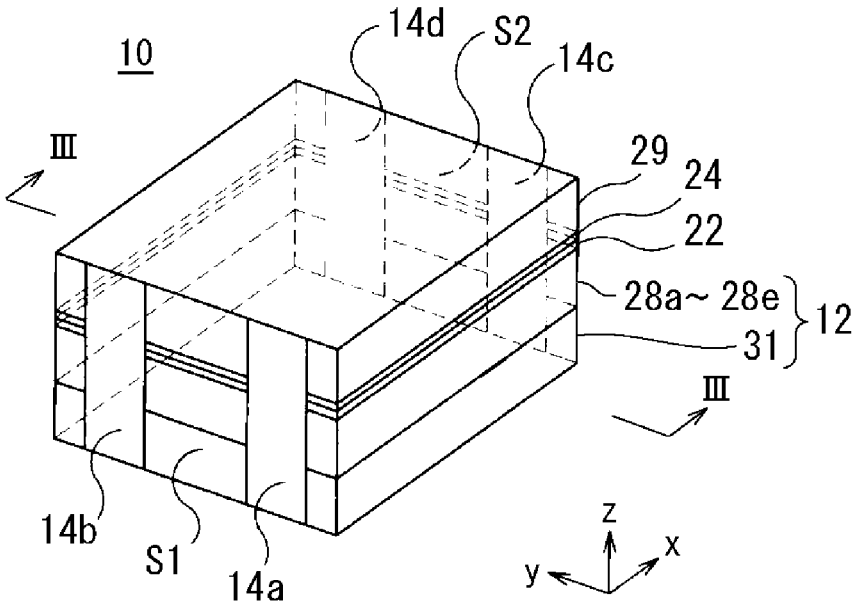
FIG. 1 is a perspective view of the appearance of an exemplary common mode choke coil as an electronic component according to an embodiment of the present disclosure.
Figure 2:
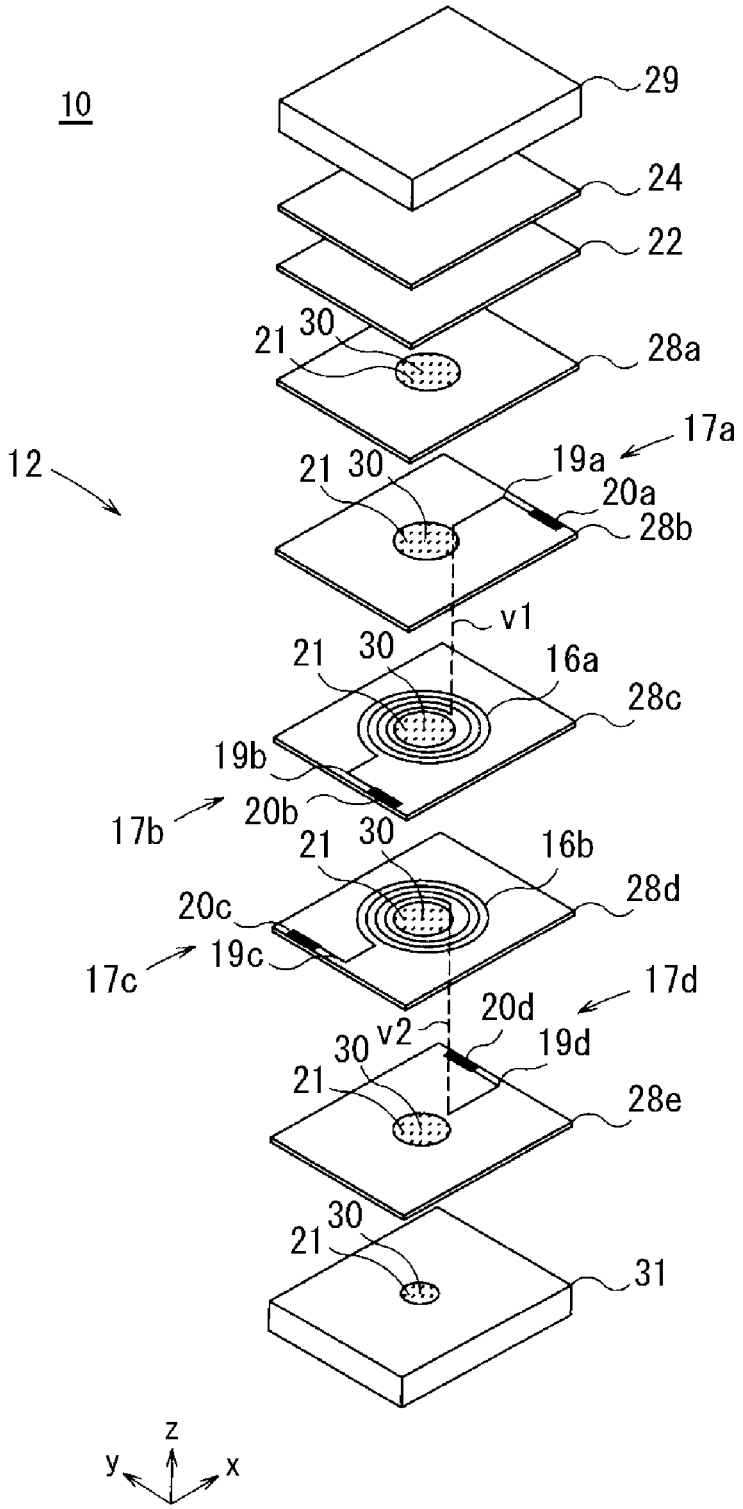
FIG. 2 is an exploded perspective view of the common mode choke coil illustrated in FIG. 1.
Figure 3:
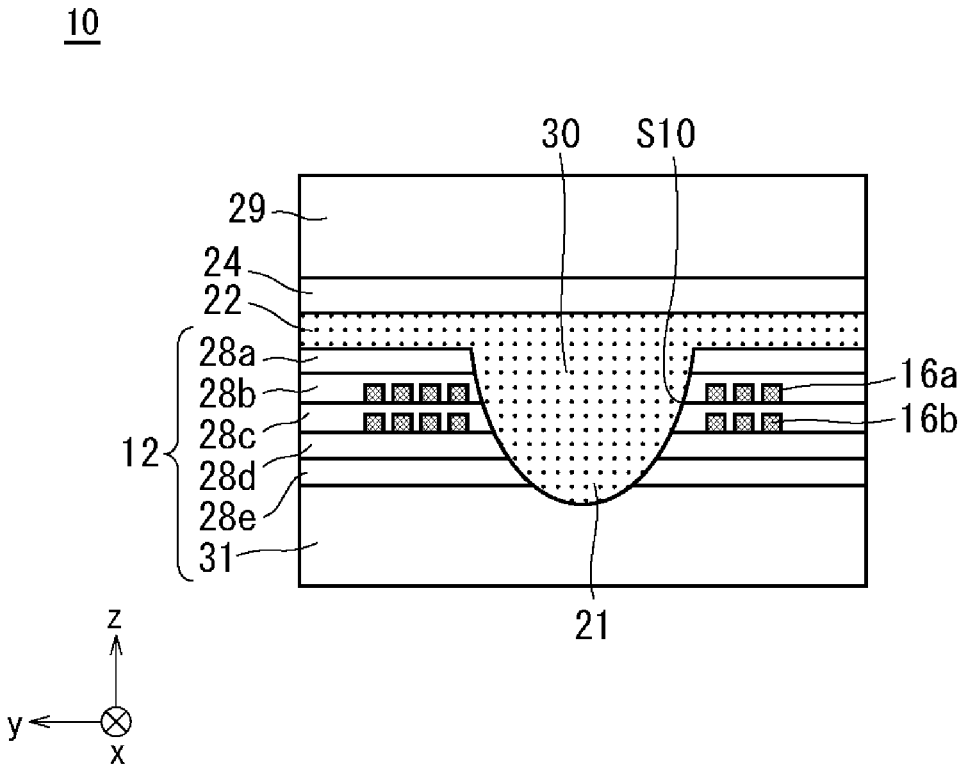
FIG. 3 is a cross-sectional view along the line III-III in FIG. 1.

FIG. 1 is a perspective view of the appearance of an exemplary common mode choke coil as an electronic component according to an embodiment of the present disclosure. FIG. 2 is an exploded perspective view of the common mode choke coil illustrated in FIG. 1. FIG. 3 is a cross-sectional view along the line III-III in FIG. 1.

Hereinafter, the stacking direction of the common mode choke coil 10 illustrated in FIG. 1 is defined as a z-axis direction, and in plan view from the z-axis direction (in top view), the directions of the longer side and the shorter side of the common mode choke coil 10 are defined as a x-axis direction and a y-axis direction, respectively. The x-axis, the y-axis, and the z-axis are orthogonal to each other.

The common mode choke coil 10 has a rectangular parallelepiped shape as illustrated in FIG. 1. The common mode choke coil 10, as illustrated in FIGS. 1 to 3, includes a laminate 12, outer electrodes 14*a* to 14*d*, coil conductors 16*a* and 16*b*, extended conductors 17*a* to 17*d*, via hole conductors v1 and v2, magnetic resin materials 21 and 22 (insulating materials), an adhesive layer 24, and a magnetic substrate 29. As illustrated in FIG. 1, the surface of the common mode choke coil 10 facing in the negative x-axis direction is referred to as a side surface S1, and the surface facing in the positive x-axis direction is referred to as a side surface S2.

The laminate 12, as illustrated in FIG. 1 and FIG. 2, has a rectangular parallelepiped shape and has a stacked structure including insulating layers 28*a* to 28*e* and a magnetic substrate 31 (first magnetic substrate). The insulating layers 28*a* to 28*e* are stacked in that order from the positive z-axis direction. The insulating layers 28*a* to 28*e* have a rectangular shape in top view, as illustrated in FIG. 2. The insulating layers 28*a* to 28*e* may be formed of an insulating resin material, such as a polyimide resin or a polyimideamide resin. The insulating layers 28*a* to 28*e* may be formed of an insulating inorganic material, such as glass ceramics.

As illustrated in FIG. 2, the magnetic substrate 31 is positioned in one end of the laminate 12 in the negative z-axis direction. The magnetic substrate 31 has a rectangular shape in top view. The magnetic substrate 31 is an insulating layer formed of a magnetic material, such as ferrite.

The laminate 12 further includes a recess 30, as illustrated in FIG. 2 and FIG. 3. The recess 30, which has a round shape in top view, is provided in a substantially central portion of the laminate 12 in the x-axis and y-axis directions. The recess 30 penetrates the insulating layers 28*a* to 28*e* so as to be recessed from the surface of the laminate 12 in the positive z-axis direction (i.e., the surface of the insulating layer 28*a* in the positive z-axis direction) to the negative z-axis direction. The bottom of the recess 30 is positioned between the main surfaces of the magnetic substrate 31 (first magnetic substrate).

The recess 30, as illustrated in FIG. 3, has a parabolic shape protruding in the negative z-axis direction in plan view from a direction orthogonal to the stacking direction (in side view). An inner circumferential surface S10 of the recess 30 has a continuous surface. As used herein, the term "continuous surface" denotes a smooth surface with no edges.

The recess 30 is filled with the magnetic resin material 21 (insulating material) as illustrated in FIG. 2 and FIG. 3. The magnetic resin material 21 is formed from a magnetic powder-containing resin that is a mixture of a soft magnetic metal powder and a thermosetting resin. The soft magnetic metal powder has an average particle size of 12 μm or less, preferably 5 μm. The magnetic powder-containing resin contains 65 vol % or more and 85 vol % or less of the soft magnetic metal powder. The soft magnetic metal powder is preferably formed of a crystalline Fe—Ni alloy or a crystalline Fe—Si alloy, and the thermosetting resin is preferably formed from an aromatic tetracarboxylic dianhydride and an aromatic diamine. The surface of the soft magnetic metal powder preferably has an insulating coating with an insulator containing, for example, Si and P. The magnetic resin material 21 has a higher magnetic permeability than the insulating layers 28*a* to 28*e*.

The coil conductors 16*a* (first coil conductor) and 16*b* (second coil conductor) are provided in the laminate 12 and electromagnetically coupled to each other to form a common mode choke coil, as illustrated in FIG. 2 and FIG. 3. More specifically, the coil conductor 16*a* is a line conductor provided on the surface of the insulating layer 28*c* facing in the positive z-axis direction. The coil conductor 16*b* is a line conductor provided on the surface of the insulating layer 28*d* facing in the positive z-axis direction. That is, the coil conductors 16*a* and 16*b* face each other in the z-axis direction with the insulating layer 28*c* interposed therebetween. The coil conductors 16*a* and 16*b* both have a spiral shape in such a manner that these coil conductors are clockwisely winding around the recess 30 and approaching the center.

The extended conductor 17*a* is provided on a surface of the insulating layer 28*b* of the laminate 12, the surface facing in the positive z-axis direction, as illustrated in FIG. 2. The extended conductor 17*a* extends from the position corresponding to the inner end of the coil conductor 16*a* to the side surface S2 of the common mode choke coil 10 in top view. More specifically, the extended conductor 17*a* includes an extending part 19*a* and a connecting part 20*a*. One end of the extending part 19*a* in the negative x-axis direction corresponds to the inner end of the coil conductor 16*a* in top view. The extending part 19*a* linearly extends from the end in the negative x-axis direction approximately to the side of the insulating layer 28*b* in the positive x-axis direction and bends in the negative y-axis direction. The connecting part 20*a* is connected to another end of the extending part 19*a* and extends to the side of the insulating layer 28*b* in the positive x-axis direction. The connecting part 20*a* is accordingly exposed from the side surface S2 of the common mode choke coil 10 in a line extending in the y-axis direction.

The extended conductor 17*b* is provided on a surface of the insulating layer 28*c* of the laminate 12, the surface facing in the positive z-axis direction, as illustrated in FIG. 2. The extended conductor 17*b* extends from the outer end of the coil conductor 16*a* to the side surface S1 of the common mode choke coil 10. More specifically, the extended conductor 17*b* includes an extending part 19*b* and a connecting part 20*b*. The extending part 19*b* linearly extends from the outer end of the coil conductor 16*a* approximately to the side of the insulating layer 28*c* in the negative x-axis direction and bends in the negative y-axis direction. The connecting part 20*b* is connected to an end of the extending part 19*b* and extends to the side of the insulating layer 28*c* in the negative x-axis direction. The connecting part 20*b* is accordingly exposed from the side surface S1 of the common mode choke coil 10 in a line extending in the y-axis direction.

As illustrated in FIG. 2, the extended conductor 17*c* is provided on a surface of the insulating layer 28*d* of the laminate 12, the surface facing in the positive z-axis direction. The extended conductor 17*c* extends from the outer end of the coil conductor 16*b* to the side surface S1 of the common mode choke coil 10. More specifically, the extended conductor 17*c* includes an extending part 19*c* and a connecting part 20*c*. The extending part 19*c* linearly extends from the outer end of the coil conductor 16*b* approximately to the side of the insulating layer 28*d* in the negative x-axis direction and bends in the positive y-axis direction. The connecting part 20*c* is connected to an end of the extending part 19*c* and extends to the side of the insulating layer 28*d* in the negative x-axis direction. The connecting part 20*c* is accordingly exposed from the side surface S1 of the common mode choke coil 10 in a line extending in the y-axis direction.

As illustrated in FIG. 2, the extended conductor 17*d* is provided on the surface of the insulating layer 28*e* of the laminate 12, the surface facing in the positive z-axis direction. The extended conductor 17*d* extends from the position corresponding to the inner end of the coil conductor 16*b* to the side surface S2 of the common mode choke coil 10 in top view. More specifically, the extended conductor 17*d* includes an extending part 19*d* and a connecting part 20*d*. One end of the extending part 19*d* in the negative x-axis direction corresponds to the inner end of the coil conductor 16*b* in top view. The extending part 19*d* linearly extends from the end in the negative x-axis direction approximately to the side of the insulating layer 28*e* in the positive x-axis direction and bends in the positive y-axis direction. The connecting part 20*d* is connected to another end of the extending part 19*d* and extends to the side of the insulating layer 28*e* in the positive x-axis direction. The connecting part 20*d* is accordingly exposed from the side surface S2 of the common mode choke coil 10 in a line extending in the y-axis direction.

The via hole conductor v1, as illustrated in FIG. 2, penetrates the insulating layer 28*b* in the z-axis direction, and connects the inner end of the coil conductor 16*a* and one end of the extending part 19*a* of the extended conductor 17*a* in the negative x-axis direction. The via hole conductor v2, as illustrated in FIG. 2, penetrates the insulating layer 28*d* in the z-axis direction, and connects the inner end of the coil conductor 16*b* and one end of the extending part 19*d* of the extended conductor 17*d* in the negative x-axis direction.

As illustrated in FIG. 1, the outer electrodes 14*a* and 14*b* are provided on the side surface S1 of the common mode choke coil 10, and are connected to the extended conductors 17*b* and 17*c*, respectively. More specifically, the outer electrodes 14*a* and 14*b* are provided on the side surface S1 to extend in the z-axis direction. In addition, the outer electrodes 14*a* and 14*b* are disposed in that order from the negative y-axis direction to the positive y-axis direction. The outer electrode 14*a* is connected to the connecting part 20*b* of the extended conductor 17*b*. The outer electrode 14*b* is connected to the connecting part 20*c* of the extended conductor 17*c*.

As illustrated in FIG. 1, the outer electrodes 14*c* and 14*d* are provided on the side surface S2 of the common mode choke coil 10, and are connected to the extended conductors 17*a* and 17*d*, respectively. More specifically, the outer electrodes 14*c* and 14*d* are provided on the side surface S2 to extend in the z-axis direction. In addition, the outer electrodes 14*c* and 14*d* are disposed in that order from the negative y-axis direction to the positive y-axis direction. The outer electrode 14*c* is connected to the connecting part 20*a* of the extended conductor 17*a*. The outer electrode 14*d* is connected to the connecting part 20*d* of the extended conductor 17*d*.

On the surface of the insulating layer 28*a* of the laminate 12 in the positive z-axis direction, the magnetic resin material 22 is provided in the form of a layer as illustrated in FIG. 2 and FIG. 3. The magnetic resin material 22 has a rectangular shape in top view. The magnetic resin material 22 is formed of a magnetic powder-containing resin that is a mixture of a soft magnetic metal powder and a thermosetting resin. The soft magnetic metal powder has an average particle size of 12 μm or less, preferably 5 μm. The magnetic powder-containing resin contains 65 vol % or more and 85 vol % or less of the soft magnetic metal powder. The soft magnetic metal powder is preferably formed of a crystalline Fe—Ni alloy or a crystalline Fe—Si alloy, and the thermosetting resin is preferably formed from an aromatic tetracarboxylic dianhydride and an aromatic diamine. The surface of the soft magnetic metal powder preferably has an insulating coating with an insulator containing, for example, Si and P. In this embodiment, the magnetic resin material 22 and the magnetic resin material 21 are formed of the same material.

As illustrated in FIG. 2 and FIG. 3, a magnetic substrate 29 (second magnetic substrate) is provided on the surface of the magnetic resin material 22 in the positive z-axis direction with the adhesive layer 24 interposed therebetween. The magnetic substrate 29 has a rectangular shape in top view. The magnetic substrate 29 is a magnetic substrate formed of a magnetic material, such as ferrite. The magnetic substrate 29 is disposed opposite to the magnetic substrate 31 (first magnetic substrate) to sandwich the adhesive layer 24, the magnetic resin material 22, and the insulating layers 28*a* to 28*e* including the coil conductors 16*a* and 16*b* and the like. The adhesive layer 24 is formed of a thermosetting adhesive, such as epoxy resins, to improve the adhesive strength between the magnetic resin material 22 and the magnetic substrate 29.

In the common mode choke coil 10 having the above configuration, the coil conductors 16*a* and 16*b* are aligned with each other in top view. This allows a magnetic flux generated by the coil conductor 16*a* to pass through the coil conductor 16*b* and allows a magnetic flux generated by the coil conductor 16*b* to pass through the coil conductor 16*a*. Thus, the coil conductor 16*a* is magnetically coupled to the coil conductor 16*b*, so that the coil conductor 16*a* and the coil conductor 16*b* constitute a common mode choke coil. The outer electrodes 14*a* and 14*b* are used as input terminals, whereas the outer electrodes 14*c* and 14*d* are used as output terminals. That is, differential transmission signals are inputted from the outer electrodes 14*a* and 14*b* and outputted from the outer electrodes 14*c* and 14*d*. When differential transmission signals contain common mode noise, the coil conductors 16*a* and 16*b* generate magnetic fluxes in the same direction due to the common-mode noise current. Thus, the magnetic fluxes intensify each other to generate impedance for the common-mode noise current. As a result, the common-mode noise current is converted into heat and prevented from passing through the coil conductors 16*a* and 16*b*. When a normal-mode current flows, the coil conductors 16*a* and 16*b* generate magnetic fluxes in opposite directions. The magnetic fluxes thus cancel each other to generate no impedance for the normal-mode current. Therefore, the normal-mode current can pass through the coil conductors 16*a* and 16*b*.

Next, a description is made of an exemplary method for producing the common mode choke coil 10. A method for producing a single common mode choke coil 10 will be described below. Practically, a mother laminate in which a plurality of laminates 12, magnetic resin materials 22, adhesive layers 24, and magnetic substrates 29 are jointed together is prepared and cut into chips. The outer electrodes 14*a* to 14*d* are then formed on the chips to give common mode choke coils 10.

First, the insulating layer 28*e* formed of a polyimide resin or a polyimideamide resin is formed on the magnetic substrate 31. Specifically, the magnetic substrate 31 is coated with a resin layer by spin coating to form the insulating layer 28*e*.

On the formed insulating layer 28*e*, the extended conductor 17*d* mainly composed of a highly conductive material, such as Ag, Cu, or Au, is formed by photolithography.

Specifically, a metal film is formed over the surface of the insulating layer 28*e* by, for example, plating, vapor deposition, or sputtering. The metal film is coated with a photosensitive resist film, followed by exposure to light and development. After that, an area of the metal film exposed from the photosensitive resist film is removed by etching, and the photosensitive resist film is then removed by an organic solvent. The extended conductor 17*d* is accordingly formed.

Next, the insulating layer 28*d* formed of a polyimide resin or a polyimideamide resin is formed on the insulating layer 28*e* and the extended conductor 17*d* by photolithography. Specifically, the insulating layer 28*e* is coated with a photosensitive resin film by spin coating. The photosensitive resin film is subjected to exposure to light and development to form the insulating layer 28*d* having a via hole to be used for the via hole conductor v2.

On the formed insulating layer 28*d*, the coil conductor 16*b*, the extended conductor 17*c*, and the via hole conductor v2 that are mainly composed of a highly conductive material, such as Ag, Cu, or Au, are formed by photolithography. Specifically, a metal film is formed over the surface of the insulating layer 28*d* by, for example, plating, vapor deposition, or sputtering. At this time, the via hole of the insulating layer 28*d* is filled with metal to form the via hole conductor v2. The metal film is coated with a photosensitive resist film, followed by exposure to light and development. After that, an area of the metal film exposed from the photosensitive resist film is removed by etching, and the photosensitive resist film is then removed. The coil conductor 16*b*, the extended conductor 17*c*, and the via hole conductor v2 are accordingly formed.

Thereafter, the step of forming the insulating layer 28*d*, and the step of forming the coil conductor 16*b*, the extended conductor 17*c*, and the via hole conductor v2 are repeated similarly. This forms the insulating layers 28*a* to 28*c*, the coil conductor 16*a*, the extended conductors 17*a* and 17*b*, and the via hole conductor v1. The laminate 12 is completed through the above process (first process).

Furthermore, the recess 30 is formed using a dry film resist and sandblasting (second process). More specifically, a photosensitive resin film is attached to the insulating layer 28*a*. After attachment, an area other than the recess 30 (photo-receiving area) is irradiated with light. An area that is not irradiated with light (non-photo-receiving area) is then removed by development. Subsequently, the area subjected to the removal by development is sandblasted. The insulating layers 28*a* to 28*e* and the magnetic substrate 31 are accordingly abraded by sandblasting to form the recess 30. Sandblasting allows the recess 30 to penetrate the insulating layers 28*a* to 28*e*. The bottom of the recess 30 reaches the magnetic substrate 31. Since the recess 30 is simultaneously formed in the insulating layers 28*a* to 28*e* and the magnetic substrate 31 by using sandblasting, the inner circumferential surface S10 of the recess 30 is smooth with no edges. After the recess 30 is formed, the photo-receiving area of the photosensitive resin film is removed.

Next, by screen printing, the magnetic resin material (insulating material) is forced into the recess 30 and the magnetic resin material 22 is formed in the form of a layer (third process). Specifically, a magnetic powder-containing resin paste is placed on the insulating layer 28*a*, and in this state, a squeegee is pushed and slid against the insulating layer 28*a*. Then, the magnetic powder-containing resin paste is thermally cured. Accordingly, the magnetic resin material 21 is forced into the recess 30 and the magnetic resin material 22 is formed.

The magnetic powder-containing resin used for forming the magnetic resin materials 21 and 22 is a material mixture of a soft magnetic metal powder and resin varnish containing an aromatic tetracarboxylic dianhydride and an aromatic diamine dissolved in an organic solvent. In this case, the soft magnetic metal powder has an average particle size of 12 μm or less (preferably 5.0 μm) and an aspect ratio of, for example, 0.65. The magnetic powder-containing resin used contains 65 vol % or more and 85 vol % or less of the soft magnetic metal powder. Furthermore, a crystalline Fe—Ni alloy or a crystalline Fe—Si alloy is preferably used as the soft magnetic metal powder in order to ensure higher magnetic permeability μ and Z values. The surface of the soft magnetic metal powder preferably has an insulating coating with an insulator containing, for example, Si and P.

Examples of the aromatic tetracarboxylic dianhydride include pyromellitic dianhydride (PMDA), 3,3',4,4'-biphenyl tetracarboxylic acid (BPDA), 2,2-bis(3,4-dicarboxyphenyl)hexafluoropropane dianhydride (6FDA), 3,3',4,4'-benzophenone tetracarboxylic dianhydride, 2,2',3,3'-benzophenone tetracarboxylic dianhydride, 2,3,3',4'-benzophenone tetracarboxylic dianhydride, naphthalene-1,2,5,6-tetracarboxylic dianhydride, naphthalene-1,2,4,5-tetracarboxylic dianhydride, naphthalene-1,4,5,8-tetracarboxylic dianhydride, and naphthalene-1,2,6,7-tetracarboxylic dianhydride.

Examples of the aromatic diamine include 4,6-dimethyl-m-phenylenediamine, 2,5-dimethyl-p-phenylenediamine, 2,4-diaminomesitylene, 2,4-toluenediamine, m-phenylenediamine, 3,3'-diaminodiphenylethane, 4,4'-diaminodiphenylmethane, 3,3'-diaminodiphenylmethane, 4,4'-diaminodiphenyl sulfide, 3,3'-diaminodiphenyl sulfone, 4,4'-diaminodiphenyl ether, 3,3'-diaminodiphenyl ether, 1,3-bis(3-aminophenoxy)benzene, 1,3-bis(4-aminophenoxy)benzene, 1,4-bis(4-aminophenoxy)benzene, benzidine, 3,3'-diaminobiphenyl, 3,3'-dimethyl-4,4'-diaminobiphenyl, 3,3'-dimethoxybenzidine, and 4,4"-diamino-p-terphenyl.

Examples of organic solvents used for dissolving the aromatic tetracarboxylic dianhydride and the aromatic diamine include N-methylpyrrolidone (NMP) and γ-butyrolactone.

Examples of the crystalline Fe—Ni alloy include 78 permalloy (permalloy A), 36 permalloy (permalloy D), 45 permalloy (permalloy B), and 42 permalloy. Examples of the crystalline Fe—Si alloy include silicon steels (e.g., 6.5% silicon steel and non-oriented silicon steel), Fe—Si—Cr alloys (e.g., Fe-4Si-5Cr and Fe-5Cr-3Si), and Sendust alloys (Fe-9.5Si-5.5Al). These alloys may be used alone or in combination as soft magnetic metal powder.

The magnetic resin materials 21 and 22 are cured at curing temperatures of 250° C. or more. The cured magnetic resin materials 21 and 22 without any defects are obtained, as long as the equivalent ratio of the aromatic tetracarboxylic dianhydride and the aromatic diamine ranges from 80:100 to 100:80.

Subsequently, a thermosetting adhesive, such as an epoxy resin, is applied to the magnetic resin material 22 to form the adhesive layer 24. The magnetic substrate 29 is attached to the adhesive layer 24. Subsequently, the magnetic resin material 22 and the magnetic substrate 29 are bonded to each other by performing heating.

Next, an assembly of the laminate 12, the magnetic resin material 22, the adhesive layer 24, and the magnetic substrate 29 is cut into chips by dicing. The chips are subjected to barrel finishing for chamfering.

Next, conductor films mainly composed of Ag are formed on the laminate 12, the magnetic resin material 22, the adhesive layer 24, and the magnetic substrate 29 by using a shield plate, such as a metal mask.

Finally, the conductor films are subjected to Ni/Sn plating to form the outer electrodes 14*a* to 14*d*. The common mode choke coil 10 is completed according to the above process.

In the common mode choke coil 10, the magnetic resin material 21 filling the recess 30 of the laminate 12 is formed of a magnetic powder-containing resin that is a mixture of a soft magnetic metal powder and a thermosetting resin. The soft magnetic metal powder has an average particle size of 12 μm or less, and the magnetic resin material is a magnetic powder-containing resin containing 65 vol % or more and 85 vol % or less of the soft magnetic metal powder. The common mode choke coil thus achieves increased Z values (increased μ values) in a high-frequency area, and can be used as, for example, a common mode filter adapted for high frequency differential transmission.

In particular, the coil conductors 16*a* and 16*b* are magnetically coupled to each other in the common mode choke coil 10, and the magnetic coupling is enhanced by using the magnetic resin material 21 in a magnetic core part (central part of the coil conductors 16*a* and 16*b*) to increase common mode impedance values (Z values), while the reduced direct current resistance (Rdc) is achieved due to the reduced number of windings of the coil conductors.

When the soft magnetic metal powder is formed of a crystalline Fe—Ni alloy or a crystalline Fe—Si alloy and the thermosetting resin is formed from an aromatic tetracarboxylic dianhydride and an aromatic diamine in the common mode choke coil 10, increased Z values (increased μ values) are achieved in a much higher frequency area and the filling ability and printing ability of the magnetic resin materials 21 and 22 can be improved due to reduced viscosity.

When the soft magnetic metal powder has a surface with an insulating coating in the common mode choke coil 10, increased Z values (increased μ values) and increased Q values are achieved in a much higher frequency area and the common mode choke coil 10 is used as, for example, a common mode filter adapted for high frequency differential transmission.

Experimental Example 1

In Experimental Example 1, the common mode choke coil 10 illustrated in FIG. 1 was produced by changing the conditions as shown in Table 1, and the material characteristics and product characteristics of the common mode choke coil 10 were determined.

In this case, the metal kind, crystallinity, average particle size, and fill volume of the soft magnetic metal powder for forming the magnetic resin materials 21 and 22 were listed in the conditions shown in Table 1.

A polyimide resin was used as a material of the insulating layers 28*a* to 28*e*.

Silver (Ag) was used as a material of the coil conductors 16*a* and 16*b*, the extended conductors 17*a* to 17*d*, and the via hole conductors v1 and v2.

The common mode choke coil 10 was formed to have outer dimensions of 0.45 mm×0.30 mm×0.30 mm.

The real part μ' and imaginary part μ" of the magnetic permeability μ and the magnetic permeability μ of a ring-shaped material (toroidal core) of the magnetic resin materials 21 and 22 are determined as the material characteristics of the common mode choke coil 10. The impedance value of the common mode choke coil 10 was determined as the product characteristics of the common mode choke coil 10.

The material characteristics and product characteristics were measured using "Agilent E4991A RF impedance/material analyzer (Agilent Technologies, Inc.)" as a characteristic measuring device for determining the material characteristics and product characteristics. In this case, the ring-shaped material (toroidal core) of the magnetic resin materials 21 and 22 was introduced into a cavity resonator. The Z value, the L value, and the R value were obtained from the change in impedance of the toroidal core before and after the introduction, and the μ' value and the μ" value were further calculated. The impedance value (Z value) of the common mode choke coil 10 at 100 MHz was determined as the product characteristics of the common mode choke coil 10.

The results of the material characteristics and the product characteristics were summarized in Table 1.

The results shown in Table 1 indicate that common mode filter characteristics, that is, characteristics with a Z value of 58.5Ω or more at 100 MHz are obtained when the fill volume of 42 permalloy (powder having an average particle size D50 of 5.0 μm) as soft magnetic metal powder ranges from 65 vol % or more and 85 vol % or less. The specification of the common mode choke coil 10 is as follows: the nominal value, maximum value, and minimum value of

TABLE 1

| Metal | | Average Particle | Fill Volume | Material Characteristics | | | | Product Characteristics |
|---|---|---|---|---|---|---|---|---|
| Kind | Crystallinity | Size (μm) | (Vol %) | μ' | μ" | μ | Q | Z (Ω) |
| Ferrite | Crystal | 1.2 | 60 | 5.6 | 0.5 | 5.6 | 11.8 | 23.1 |
| Fe42Ni | Crystal | 5.0 | 85 | 19.4 | 3.9 | 19.8 | 4.4 | 81.9 |
| Fe42Ni | Crystal | 5.0 | 80 | 20.1 | 4.4 | 20.6 | 4.6 | 90.0 |
| Fe42Ni | Crystal | 5.0 | 75 | 20.5 | 4.5 | 21.0 | 4.6 | 92.0 |
| Fe42Ni | Crystal | 5.0 | 70 | 16.3 | 2.9 | 16.6 | 5.7 | 72.6 |
| Fe42Ni | Crystal | 5.0 | 67 | 14.5 | 2.3 | 14.7 | 6.5 | 64.2 |
| Fe42Ni | Crystal | 5.0 | 66 | 13.9 | 2.1 | 14.0 | 6.7 | 62.0 |
| Fe42Ni | Crystal | 5.0 | 65 | 13.3 | 1.9 | 13.4 | 7.0 | 58.6 |
| Fe42Ni | Crystal | 5.0 | 64 | 12.6 | 1.7 | 12.7 | 7.4 | 55.6 |
| Fe42Ni | Crystal | 5.0 | 60 | 9.9 | 1.1 | 10.0 | 9.0 | 43.6 |
| Fe42Ni | Crystal | 5.0 | 55 | 8.1 | 0.7 | 8.2 | 11.5 | 35.7 |
| Fe42Ni | Crystal | 5.0 | 50 | 7.1 | 0.5 | 7.1 | 13.5 | 31.3 |
| Fe42Ni | Crystal | 5.0 | 45 | 5.8 | 0.3 | 5.8 | 18.5 | 25.3 |
| | | | | | | Component Specification | Nominal Value | 90.0 |
| | | | | | | | Maximum | 121.5 |
| | | | | | | | Minimum | 58.5 |
| | | | | | | | Acceptable Range | 90 Ω ± 35% |

impedance are 90.0 Ω, 121.5Ω, and 58.5Ω respectively with an acceptable range of 90 Ω±35%, as shown in Table 1.

The common mode choke coil 10 within the scope of the present disclosure can accordingly ensure a high impedance value.

Experimental Example 2

The common mode choke coil 10 illustrated in FIG. 1 was produced by changing the conditions as shown in Table 2 in Experimental Example 2 as compared with Experimental Example 1, and the material characteristics and product characteristics of the common mode choke coil 10 were determined.

Silver (Ag) was used as a material of the coil conductors 16*a* and 16*b*, the extended conductors 17*a* to 17*d*, and the via hole conductors v1 and v2.

The common mode choke coil 10 was formed to have outer dimensions of 0.45 mm×0.30 mm×0.30 mm.

The material characteristics and product characteristics of the common mode choke coil 10 were determined as in Experimental Example 1, and the results of the material characteristics and the product characteristics were summarized in Table 2.

The results shown in Table 2 indicate that common mode filter characteristics, that is, characteristics with a Z value of 58.5Ω or more at 100 MHz are obtained in the common mode choke coil 10 when the soft magnetic metal powder has an average particle size of 12 μm or less at a fill volume of the soft magnetic metal powder of 75 vol % which is within the scope of the present disclosure.

TABLE 2

| Metal | | Insulating | Average Particle | Fill Volume | Material Characteristics | | | | Product Characteristics |
|---|---|---|---|---|---|---|---|---|---|
| Kind | Crystallinity | Coating | Size (μm) | (Vol %) | μ' | μ" | μ | Q | Z (Ω) |
| Fe42Ni | Crystal | Formed | 0.9 | 75 | 19.5 | 2.20 | 20.1 | 8.9 | 82.1 |
| Fe—Si—Cr | Crystal | Formed | 1.0 | 75 | 19.2 | 2.50 | 20.4 | 7.7 | 83.3 |
| Fe—Si—Cr | Amorphous | Formed | 1.0 | 75 | 13.4 | 1.10 | 15.6 | 12.2 | 64.1 |
| Fe42Ni | Crystal | Formed | 3.5 | 75 | 20.6 | 3.20 | 21.1 | 6.4 | 85.0 |
| Fe—Si—Cr | Crystal | Formed | 3.1 | 75 | 22.7 | 3.80 | 23.0 | 6.0 | 94.2 |
| Fe—Si—Cr | Amorphous | Formed | 3.0 | 75 | 15.8 | 1.52 | 16.1 | 10.4 | 65.3 |
| Fe42Ni | Crystal | Not formed | 5.0 | 75 | 20.5 | 4.50 | 21.0 | 4.6 | 92.0 |
| Fe42Ni | Crystal | Formed | 5.0 | 75 | 22.5 | 4.43 | 22.9 | 5.1 | 94.6 |
| Fe—Si—Cr | Crystal | Formed | 5.0 | 75 | 20.4 | 3.57 | 20.8 | 5.7 | 86.0 |
| Fe—Si—Cr | Crystal | Not formed | 5.0 | 75 | 21.7 | 7.07 | 22.4 | 3.1 | 92.6 |
| Fe—Si—Cr | Amorphous | Formed | 5.2 | 75 | 15.5 | 1.90 | 15.8 | 8.2 | 66.0 |
| Fe—Si—Cr | Amorphous | Not formed | 5.3 | 75 | 16.1 | 2.10 | 16.5 | 7.7 | 69.2 |
| Fe42Ni | Crystal | Not formed | 10.1 | 75 | 21.0 | 5.50 | 21.1 | 3.8 | 87.5 |
| Fe42Ni | Crystal | Formed | 10.4 | 75 | 22.5 | 5.70 | 23.0 | 3.9 | 95.0 |
| Fe—Si—Cr | Crystal | Formed | 10.0 | 75 | 19.3 | 5.98 | 19.9 | 3.2 | 82.4 |
| Fe—Si—Cr | Crystal | Not formed | 9.7 | 75 | 21.7 | 7.07 | 22.4 | 3.1 | 92.4 |
| Fe—Si—Cr | Amorphous | Not formed | 10.1 | 75 | 16.2 | 4.60 | 16.5 | 3.5 | 69.0 |
| Fe—Si—Cr | Amorphous | Formed | 10.0 | 75 | 16.8 | 4.40 | 17.0 | 3.8 | 71.1 |
| Fe—Si | Crystal | Formed | 10.0 | 75 | 17.8 | 5.80 | 18.4 | 3.1 | 76.1 |
| Fe42Ni | Crystal | Not formed | 12.0 | 75 | 23.2 | 5.80 | 23.5 | 4.0 | 98.0 |
| Fe—Si—Cr | Crystal | Not formed | 12.0 | 75 | 25.1 | 8.10 | 26.5 | 3.1 | 111.0 |
| Fe—Si—Cr | Amorphous | Not formed | 12.0 | 75 | 17.1 | 4.90 | 17.5 | 3.5 | 72.0 |
| Fe—Si—Cr | Amorphous | Formed | 12.0 | 75 | 15.5 | 1.90 | 15.8 | 8.2 | 65.2 |

In this case, the metal kind, crystallinity, insulating coat (insulating coating), average particle size, and fill volume of the soft magnetic metal powder for forming the magnetic resin materials 21 and 22 were listed in the conditions shown in Table 2.

In the insulating coating of the soft magnetic metal powder, Fe42Ni (crystal), Fe—Si—Cr (crystal), and Fe—Si (crystal) were treated with phosphate coating using a P-containing phosphate coating agent and Fe—Si—Cr (amorphous) was treated with silane coupling using a Si-containing silane coupling agent. The phosphate coating treatment is a typical conversion coating method and is used to form a thin film (micron-order film) of metal salts, such as zinc phosphate, on the surface of metals, such as steel and zinc. The silane coupling treatment is a typical method for forming strong chemical bonding by adhesion of a silane coupling agent on an inorganic surface through hydrogen bonding and causing a dehydration/condensation reaction and is used to form a thin film (tens-micron-order film) of oxides, such as silicon oxide, on the surface of metals, such as steel and zinc. In particular, a soft magnetic metal powder having a small particle size (average particle size) may be subject to oxidation combustion, and thus requires insulating coating to prevent oxidation combustion.

A polyimide resin was used as a material of the insulating layers 28*a* to 28*e*, as in Experimental Example 1.

The results shown in Table 2 also indicate that the common mode choke coil 10 achieves increased Q values by insulating coating of the surface of the soft magnetic metal powder. The use of amorphous powder as soft magnetic metal powder reduces the common mode filter characteristics within the scope of objectives of the present disclosure, but may cause an increase in Q value.

The results shown in Table 2 also indicates soft magnetic metal powder that is crystalline and finer is preferably used to ensure high Z values and high Q values.

In the common mode choke coil 10, the recess 30 has a parabolic shape protruding in the negative z-axis direction in side view. The magnetic resin material 21 has a shape corresponding to that of the recess 30. In the present disclosure, the recess 30 and the magnetic resin material 21 may be formed to have other shapes, such as cylindrical shape or prism shape.

In the common mode choke coil 10, the recess 30 is formed using a dry film resist and sandblasting, but the recess 30 may be formed using laser machining.

Although the common mode choke coil 10 has two coil conductors 16*a* and 16*b* and the magnetic resin material 21, the present disclosure may be applied to other electronic components, such as inductors having one coil conductor and a magnetic resin material and filters having three or more coil conductors and a magnetic resin material. In addition, the present disclosure may be applied to electronic components having elements, such as a capacitor element, a resistance element, or an active element, in addition to a coil conductor and a magnetic resin material.

The electronic component according to the present disclosure is preferably used as an electronic component, such as a common mode choke coil, including a coil conductor and a magnetic resin material.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a laminate including a plurality of insulating layers stacked in a thickness direction and having a recess recessed in a stacking direction of the plurality of insulating layers, the recess being filled with a magnetic resin material; and at least one coil conductor provided in the laminate, wherein the magnetic resin material is formed of a magnetic powder-containing resin that is a mixture of a soft magnetic metal powder and a thermosetting resin, the soft magnetic metal powder has an average particle size of 12 μm or less, the magnetic powder-containing resin contains 65 vol % or more and 85 vol % or less of the soft magnetic metal powder, and the thermosetting resin is formed from an aromatic tetracarboxylic dianhydride and an aromatic diamine.

2. The electronic component according to claim 1, wherein the soft magnetic metal powder is formed of a crystalline Fe—Ni alloy or a crystalline Fe—Si alloy, and the thermosetting resin is a polyimide resin formed from an aromatic tetracarboxylic dianhydride and an aromatic diamine.

3. The electronic component according to claim 1, wherein the soft magnetic metal powder has a surface with an insulating coating.

4. An electronic component comprising:

a laminate including a plurality of insulating layers stacked in a thickness direction and having a recess recessed in a stacking direction of the plurality of insulating layers, the recess being filled with a magnetic resin material; and at least one coil conductor provided in the laminate, wherein the magnetic resin material is formed of a magnetic powder-containing resin that is a mixture of a soft magnetic metal powder and a thermosetting resin, the soft magnetic metal powder has an average particle size of 12 μm or less, the magnetic powder-containing resin contains 65 vol % or more and 85 vol % or less of the soft magnetic metal powder, and an inner surface of the recess continuously curves while extending through the plurality of insulating layers in the stacking direction such that the recess has a parabolic shape protruding in a negative z-axis direction in side view.

5. The electronic component according to claim 4, wherein the soft magnetic metal powder is formed of a crystalline Fe—Ni alloy or a crystalline Fe—Si alloy, and the thermosetting resin is formed from an aromatic tetracarboxylic dianhydride and an aromatic diamine.

6. The electronic component according to claim 4, wherein the soft magnetic metal powder has a surface with an insulating coating.

* * * * *